United States Patent [19]

Hue

[11] Patent Number: 4,562,654

[45] Date of Patent: Jan. 7, 1986

[54] SKI SHOE FOR CROSS-COUNTRY SKIING

[75] Inventor: Jean Hue, Annecy, France

[73] Assignee: Salomon S.A., Annecy, France

[21] Appl. No.: 580,218

[22] Filed: Feb. 15, 1984

[30] Foreign Application Priority Data

Feb. 22, 1983 [FR] France ..... 83 02817

[51] Int. Cl.[4] ..... A43B 5/04

[52] U.S. Cl. ..... 36/117; 36/119

[58] Field of Search ..... 36/116, 117, 118, 119, 36/120, 121, 128, 58.6, 7.2, 72 R

[56] References Cited

U.S. PATENT DOCUMENTS

| | | | |
|---|---|---|---|
| 2,526,831 | 10/1950 | Schaeppler | 36/119 |
| 2,539,026 | 1/1951 | Mangold | 36/119 |
| 2,883,316 | 4/1959 | Leahy | 154/50 |
| 3,228,122 | 1/1966 | Ludwig | 36/117 |
| 3,837,098 | 9/1974 | Rathmell | 36/2.5 |
| 4,282,657 | 8/1981 | Antonious | 36/129 X |

FOREIGN PATENT DOCUMENTS

| | | |
|---|---|---|
| 0804899 | 3/1951 | Fed. Rep. of Germany . |
| 2499834 | 2/1981 | France . |
| 0523643 | 7/1940 | United Kingdom . |

*Primary Examiner*—Louis K. Rimrodt

*Attorney, Agent, or Firm*—Sandler & Greenblum

[57] ABSTRACT

Sport shoe, particularly adapted to use in cross-country skiing, including a sole, a vamp, and an overshoe. The vamp is positioned in the overshoe and includes a tightening means for tightening the vamp around the instep. Both the vamp and the overshoe include a posterior portion surrounding the rear portion of the leg. The vamp and overshoe are attached to one another along their posterior portions. This attachment extends from the top of the shoe to the bottom of the shoe along the posterior portion of the vamp and the overshoe. As a result of this arrangement, when the tightening means tightens the vamp around the instep, the posterior portions of the vamp and the overshoe also tighten, thereby firmly holding the rear of the foot and the heel in the shoe.

53 Claims, 7 Drawing Figures

SKI SHOE FOR CROSS-COUNTRY SKIING

BACKGROUND OF THE INVENTION

1. Field of the Invention

The present invention relates to a sport shoe, particularly a shoe of the type used in cross-country skiing.

2. Description of Prior Art

Sport shoes, such as those of the cross-country type, comprise a sloe, preferably made of molded plastic, on which a flexible vamp is attached. Such shoes or boots are generally tightened around the foot by, for example, passing lace through holes provided in an upper lacing zone which extends along the length of the longitudinal edges of a slit provided in the upper portion of the vamp. This type of shoe firmly holds the front of the foot. However, this is not necessarily true of the heel of the wearer, which is not well maintained. Although this poor heel maintenance is not a major inconvenience during normal walking, it is a major inconvenience when practicing a sport requiring a substantial flexion of the foot, as is the case when practicing cross-country skiing. This inconvenience arises because the edge of the upper surrounding the instep tends to open during flexion of the foot. As a result, snow can enter the boot and there is overheating due to friction, which can be annoying to the skier.

To overcome these disadvantages, a sport shoe has been developed with an elongated tightening element, of adjustable length, extending behind and against the upper and posterior portion of the upper. In addition, the tightening element is inclined, on each side of the shoe, from the top to the bottom of the shoe and from the rear to the front of the shoe, to tighten the upper edge of the upper around the foot of the wearer. Such a shoe is described in French application No. 81 03085 filed by Applicant on Feb. 17, 1981. Although such a shoe makes it possible to improve the maintenance of the heel in the shoe, it does not overcome the inconvenience of having the tightening element on the exterior of the upper, which spoils the aesthetic appearance of the shoe and can, in certain cases, be bothersome.

SUMMARY OF THE INVENTION

The present invention overcomes the disadvantages discussed above by providing a shoe having a tightening means and means for effectively maintaining the heel and rear portion of the foot which are not visible from the exterior.

More particularly, the sport shoe according to the invention, which is particularly useful in cross-country skiing, comprises a sole on which a vamp is attached. The vamp comprises, at its upper portion, tightening means for tightening the vamp on the instep. The shoe itself comprises an overshoe made of flexible material extending from the front end to the rear end of the shoe and covering substantially the anterior and upper portion of the vamp, assuring the tightening of the instep. The overshoe is attached, at its posterior portion, to the vamp by attachment means such as stitching, gluing, or heat welding. The stitching extends, along at least part of the length of the upper edge of the posterior portion of the vamp comprising the upper of the shoe, and, also extends between this upper edge and the sole.

According to one aspect of the invention, the overshoe has a rapid attachment means, as its upper portion, above the tightening means of the vamp on the instep, which assures a waterproof closure of the overshoe and which provides an opening to easily access the tightening means of the vamp.

The advantage of this boot is that the tightening means of the vamp assures a perfect tightening of the upper edge of the upper of the shoe around the foot. In addition, the tightening means is entirely recessed within the overshoe, which enhances the aesthetic appearance of the shoe and avoids the annoyance inherent in an exterior tightening element.

In one embodiment, the invention comprises a shoe for housing the instep and rear portions of a foot. The shoe comprises a sole, a vamp, and a flexible overshoe covering the vamp. The vamp is attached to the sole and comprises an instep, a posterior portion, and a tightening means for tightening the vamp around the instep of the foot. In addition, the posterior portion of the overshoe is connected to the vamp. In one embodiment, the shoe is a sports shoe, and in another embodiment the shoe is a cross-country ski shoe.

The overshoe is connected to the vamp such that the overshoe comprises means for firmly maintaining the heel of the wearer in the shoe. In addition, the vamp comprises a means for maintaining the front of the foot and the heel of the foot firmly in the shoe during substantial forward flexion. In another embodiment, the shoe has an upper edge surrounding the rear portion of the foot. In this embodiment, the tightening means contracts the upper edge of the shoe around the rear portion of the foot. In an alternative embodiment, the vamp comprises an upper portion and the tightening means is provided on the upper portion of the vamp. The overshoe may be composed of flexible material, as may be the vamp.

The shoe comprises a front end and an instep. In addition, the vamp further comprises an anterior portion which comprises the instep and an upper portion. The overshoe extends to the front end of the shoe and substantially completely covers the anterior and upper portions of the vamp to assure tightening of the instep of the shoe when the tightening means tightens the vamp on the instep of the foot. The overshoe further comprises a posterior portion which is attached to the posterior portion of the vamp.

In addition, the shoe further comprises an attachment means for attaching the posterior portion of the overshoe to the vamp. The posterior portion of the vamp comprises an upper portion having an upper edge. The attachment means attaches at least a portion of this upper portion of the posterior portion of the vamp to the posterior portion of the overshoe. More particularly, the attachment means attaches at least a portion of the upper edge of the posterior portion of the vamp to the posterior portion of the overshoe. The vamp also comprises a portion between the upper edge of the posterior portion of the vamp and the sole. In this embodiment, the attachment means attaches this portion of the vamp to the posterior portion of the overshoe. The attachment means may comprise stitching, glue or a heat weld.

In an alternative embodiment, the vamp comprises an anterior portion and the tightening means is positioned on this anterior portion. In this embodiment, the overshoe comprises an upper portion above the tightening means of the vamp which is adapted to be opened and closed. In addition, the overshoe further comprises a rapid attachment means on this upper portion of the overshoe for relatively rapidly opening and closing this upper portion of the overshoe to provide access to the tightening means of the vamp. The rapid attachment means may comprise a waterproof closure for the upper portion of the overshoe.

In still another embodiment, the shoe comprises a top portion, a bottom portion, and a front and a rear portion. In this embodiment, the anterior portion of the vamp is spaced from the front end of the shoe. In addition, the anterior portion comprises an anterior edge which is inclined from the top to the bottom portion of the shoe and is inclined from the front to the rear portion of the shoe.

The tightening means may be positioned on the anterior portion of the vamp. In such an embodiment, the overshoe further comprises an upper portion above this tightening means. This upper portion of the overshoe comprises two spaced apart lips which are adapted to be overlaid, one on the other. Each lip comprises a self-sticking portion adapted to stick to the self-sticking portion of the other lip. In addition, the vamp may be one integral piece, as may be the overshoe. Also, the shoe may also comprise a heel. In this embodiment, the posterior portion of the overshoe comprises two posterior edges. The attachment means attaches the overshoe to the vamp along substantially the entire length of these two posterior edges of the overshoe. The attachment means may be parallel to these posterior edges and extends from the upper edge of the vamp to the heel of the shoe.

In still another embodiment, the vamp comprises an anterior portion which comprises the instep, and a posterior portion. The anterior and posterior portions of the vamp are independent of one another. In other words, they are spaced apart from one another. In this embodiment, the anterior portion comprises two wings, each having longitudinal edges. Each wing is attached to the sole along these longitudinal edges. The wings further comprise an upper edge. The tightening means is positioned along substantially the entire length of this upper edge. In addition, the shoe is adapted to house the heel of the wearer. The posterior portion of the vamp is adapted to surround the rear portion and the heel of the wearer and comprises means for mating tightly with the rear portion of the foot and the heel of the wearer in response to the tightening means tightening the vamp at the front portion or the instep. In addition, the posterior portion of the vamp extends frontwardly on both sides of longitudinal plane of the symmetry of the shoe. More particularly, the posterior portion of the vamp comprises a tongue which extends frontwardly on both sides of the longitudinal plane of symmetry of the shoe. This tongue extends upwardly, and comprises the tightening means.

The overshoe may also comprise a posterior portion which is attached to the posterior portion of the vamp by stitches. The posterior portion of the vamp may comprise a cutaway portion, open at the front thereof, and comprising an upper portion and a lower portion. The upper portion comprises the tongue, referred to above, and the lower portion comprises an extension, extending toward the front of the shoe and which is attached to the sole. In addition, the anterior portion of the vamp comprises a lower posterior zone which overlaps the extension referred to above. In addition, the shoe further comprises a reinforcement attached to the sole. The posterior portion of the vamp is attached to this reinforcement. In addition, the posterior portion of the vamp may be spaced from the sole, so that the posterior portion of the vamp is attached to the sole via this reinforcement. Alternatively, the posterior portion of the vamp may be attached directly to the sole. This extension discussed above may have a rounded edge.

In an alternative embodiment, in which the anterior and posterior portions of the vamp comprise one piece, the shoe comprises top and bottom portions and rear and front portions. The vamp further comprises a cutaway portion separating the anterior and posterior portions from each other on each side of the shoe. The cutaway portion is inclined from the top to the bottom portions of the shoe and from the front to the rear portions of the shoe. This cutaway portion comprises two upper anterior tongues comprising the tightening means.

In still another embodiment of the invention, the invention comprises a shoe for housing the front and rear portions of a foot. The shoe comprises an exterior portion, an interior portion, and a rear tightening means positioned on the interior portion of the shoe. The rear tightening means tightens the shoe on the rear portion of the foot in response to tightening of the shoe on the front portion of the foot. A front tightening means is also provided to tighten the shoe on the front portion of the foot. The shoe further comprises a vamp on the interior portion. The vamp comprises the front tightening means and the rear tightening means. In addition, the vamp comprises a front portion and a rear portion. The front portion comprises two spaced apart lateral wings, adapted to be displaced towards each other. The lateral wings comprise the front tightening means. The rear portion surrounds the rear portion of the foot and is connected to the front portion. In response to displacement of the lateral wings towards each other, the rear portion diminishes in size.

The shoe further comprises holding means for holding the lateral wings in a first position, which is the position in which the lateral wings are displaced toward each other. This holding means comprises at least one opening in each lateral wing, and lace adapted to be threaded and tied through the openings.

The shoe further comprises an overshoe, having a rear portion and covering the vamp and attached to the vamp such that the rear or posterior portion of the overshoe diminishes in size in response to the displacement of the lateral wings toward each other. The overshoe further comprises a front portion having two spaced apart lips, adapted to be overlaid one on the other. The lips comprise a waterproof seal when overlaid one on the other. Each lip comprises a self-sticking surface adapted to contact the self-sticking surface of the other lip when the lips are overlaid one on the other. These lips comprise means for gaining access to the front tightening means.

In another embodiment of the invention, the invention comprises a shoe comprising an upper. The upper comprises a rear portion, an overshoe, and a vamp inside the overshoe. The vamp comprises a front portion, a rear portion and a contraction means for contracting the rear portion of the shoe in response to contraction of the front portion of the vamp. The overshoe comprises a rear portion and is attached to the vamp such that the rear portion of the overshoe contracts in response to contraction of the front portion of the vamp. The front portion of the vamp is attached to the rear portion of the vamp and comprises two spaced apart lateral wings adapted to be displaced towards each other. The rear portion of the vamp contracts in response to the displacement of the lateral wings towards each other. The contraction means comprises these lateral wings. The shoe further comprises means for maintaining the position of the lateral wings after the lateral wings are displaced toward each other.

BRIEF DESCRIPTION OF THE DRAWINGS

The invention will now be described by way of non-limiting example with reference to the attached drawings in which.

DESCRIPTION OF PREFERRED EMBODIMENTS

Figure 1:
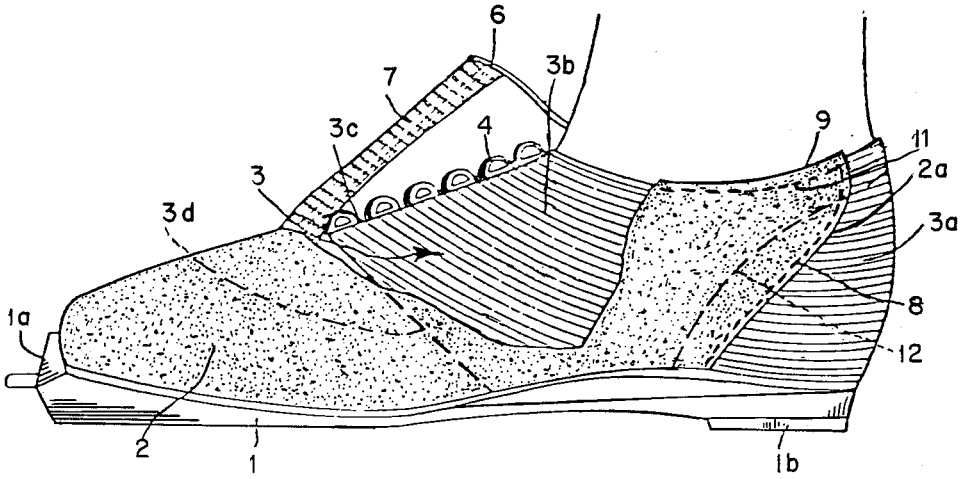
FIG. 1 is an elevational view, partially broken away, of a first embodiment of a cross-country ski shoe according to the invention.
Figure 2:
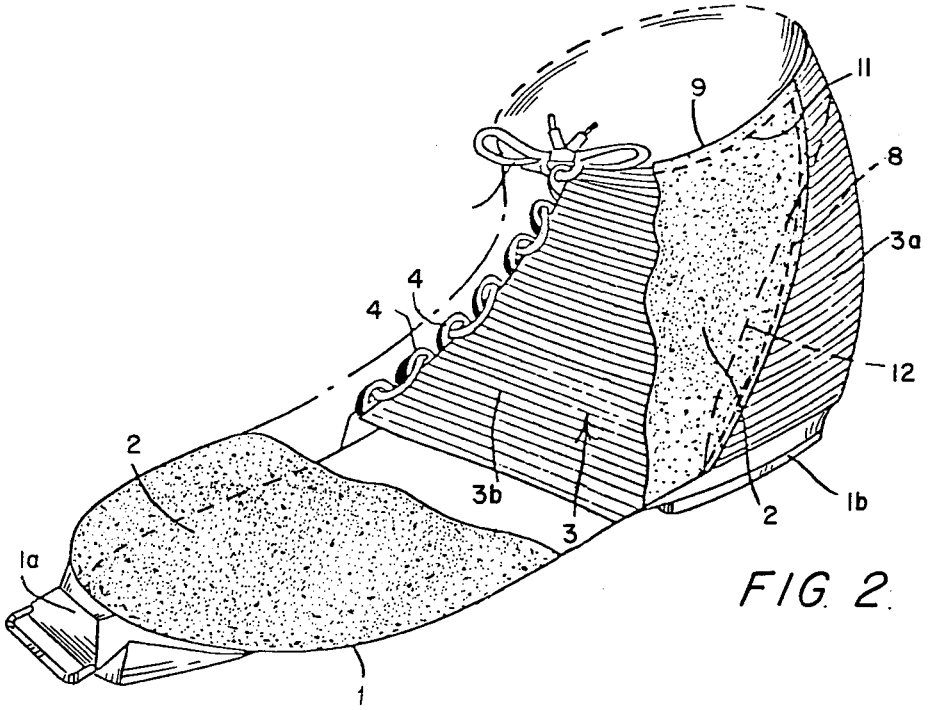
FIG. 2 is a perspective view, partially broken away, a shoe similar to that shown in FIG. 1, but with a high upper.

The ski shoes shown in FIGS. 1 and 2, which are, respectively of the low and high upper type, each comprise a sole 1 at their lower portions, which is preferably made of molded plastic. An overshoe 2 is attached to sole 1 and extends substantially over the entire length of the shoe from the anterior and 1*a* of sole 1 to substantially the heel 1*b* of the shoe. This overshoe 2 is of one piece construction and is made of a flexible and waterproof material such as coated leather cloth or synthetic fabric. A vamp 3 is positioned within overshoe 2 and is also formed of a flexible material. Vamp 3 is one integral piece and comprises a posterior portion 3*a* surrounding and mating with the external surface of the heel, and an anterior portion 3*b* extending to both sides of the front of the foot and which is pressed against the instep of the foot.

The vamp also comprises a front portion, connected to posterior portion 3*a*. In the embodiment shown in FIGS. 1 and 2, the front portion is identical to the anterior portion 3*b* and covers the instep of the shoe. However, the front portion may be separate from anterior portion 3*b*, as in the embodiment seen in FIG. 3. In this embodiment the front portion comprises tongue 14*b*. It is this front portion that causes posterior portion 3*a* of vamp 3 and the posterior portion of overshoe 2 to tighten in response to tightening of this front portion of the vamp.

Anterior portion 3*b* of vamp 3 comprises two spaced apart lateral wings ending in respective edges 3*c*. Tightening elements for the instep are provided over the length of edges 3*c*. These tightening elements can be formed of eyelets of rings 4 distributed over the length of the two upper edges 3*c*. Rings 4 are adapted to receive a tightening lace 5, which passes therethrough.

The lateral wings are adapted to be displaced toward each other and can be held in this displaced position by lace 5. When this is accomplished, anterior portion 3*b* firmly holds the front of the foot. These wings, therefore, comprise front tightening means for tightening the shoe on the front portion of the foot. Because the lateral wings are connected to posterior portion 3*a*, when the lateral wings are contracted or displaced toward each other, posterior portion 3*a* tightens or diminishes in size or contracts on the rear portion of the foot.

Anterior portion 3*b* of vamp 3 does not extend to the end of the shoe, but rather ends in an anterior edge 3*d* spaced from the front end of the shoe. Anterior edge 3*d* is preferably inclined from the top to the bottom of the shoe and and from the front to the rear of the shoe. Anterior edge 3*d* begins at the end of the corresponding upper edge 3*c* and extends to the lateral edge of sole 1.

The upper anterior portion of overshoe 2 is split, in the zone which covers edges 3*c* of vamp 3 and which is provided with eyelets 4 and lace 5. Overshoe 2 is split in a manner so as to form two spaced apart lips 6 which can be overlaid, one in the other, above lace 5 while being maintained firmly closed in a waterproof manner. In order to rapidly open and close lips 6 two auto-stick bands of the type known commercially as "VELCRO" can be used. One of these bands 7 is positioned on the peripheral portion of the lower lip 6 while the other band 7 is placed under the corresponding peripheral portion of the other upper lip 6. When the two lips are overlaid, one on the other, the two auto-stick bands contact each other. In this manner, lips 6 comprise a rapid attachment means.

Overshoe 2 and vamp 3 are attached to one another along the length of the two posterior edges 2*a* of overshoe 2. This attachment is accomplished by a stitching 8 which extends substantially parallel to posterior edge 2*a* of overshoe 2. Stitching 8 begins at or near upper edge 9 of posterior portion 3*a* of vamp 3. Posterior portion 3*a* forms the upper of the shoe which surrounds the rear portion of the foot. The posterior edge 2*a* of overshoe 2 and, consequently, stitching 8 extend along the curvature of overshoe 2, from upper edge 9 of the upper to sole 1, in a zone positioned substantially under the malleoli of the wearer. Upper edge 9 extends along the upper edge of vamp 3 and overshoe 2, and can also refer to a zone extending slightly below the upper edge of the boot. In other words, edge 9 can refer to the upper portion of vamp 3 and overshoe 2 that borders the upper edge of these elements.

Overshoe 2 and vamp 3 are also attached to and integral with one another along the length of upper edge 9 of the upper. This attachment is made by lateral stitches 11 extending substantially from a point spaced a small distance from posterior edge 2*a* of overshoe 2 to the point where upper edge 3*c* separates from upper edge 9 of vamp 3. In other words, overshoe 2 and vamp 3 are stitched to one another over substantially the entire length of upper edge 9 of the upper, with the exception of the posterior portion of edge 9. This posterior portion which has no stitching comprises the posterior portion of vamp 3. Stated in another manner, stitching 11, as seen in FIGS. 1 and 2 is spaced from posterior edge 2*a* of overshoe 2, and does not contact posterior portion 3*a* of vamp 3. Of course, depending upon the materials employed to form overshoe 2 and vamp 3, it is within the scope of the invention to replace the stitches 8 and 11, which comprise attachment means for the attachment of vamp 3 and overshoe 2, with heat welding, gluing, or any other method of attachment.

Reinforcements 12 are provided in the posterior portion of the shoe, in the heel zone and they are attached in an appropriate manner to the posterior portion 3*a* of the vamp, by, for example, being glued on the internal surface thereof.

It may be seen, from the preceding description, that the tightening of laces effectively maintains the heel in the shoe for the following reason. The tightening of the laces contracts the anterior portion of vamp 3, which in turn causes a shrinking or contraction of upper edge 9 of the vamp of the upper around the entire rear portion of the foot. This tightening of the posterior portion of upper edge 9 of vamp 3 is transmitted to the corresponding zone of overshoe 2 which is integral therewith. As a result, overshoe 2 tightens or contracts, and therefore, both vamp 3 and overshoe 2 firmly maintain the front and the rear portion and heel of the wearer in the shoe. In addition, the instep of the vamp and overshoe do not open during forward flexion of the foot.

In other words, vamp 3 comprises a rear tightening means positioned on the interior of the shoe, for tightening the shoe on the rear portion of the foot in response to tightening of the shoe on the front portion of the foot. In addition, a front tightening means is provided for tightening the shoe on the front portion of the foot. The lateral wings of vamp 3 comprises the front tightening means. The lateral wings are held in their displaced, contracted position by lace 5. The posterior portion of overshoe 2 diminishes in size or contracts or tightens in response to displacement of the lateral wings toward each other. In addition, the shoe comprises a contraction means for contracting the rear portion of shoe 1 in response to contraction of the front portion of the vamp, for example, when the lateral wings of vamp 3 are displaced toward each other.

Figure 3:
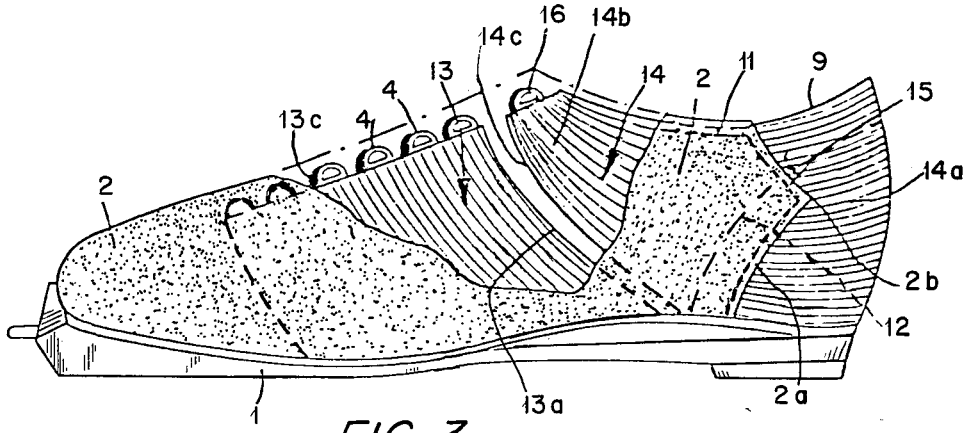
FIGS. 3, 4, 5, 6 and 7 are elevational views, partially broken away, of alternative embodiments of the shoe according to the invention.

In an alternative embodiment shown in FIG. 3, the interior vamp is formed of two portions which are independent from one another, i.e., an anterior portion 13 and a posterior portion 14.

Anterior portion 13 of the vamp comprises two wings attached to sole 1, along the length of the longitudinal edges thereof. Anterior portion 13*a* has eyelets along the length of its upper edges 13*c*. These eyelets make it possible to tighten one wing to the other and on the instep. The two wings comprise the anterior portion 13 of the vamp.

The posterior portion 14 of the vamp which generally forms a rear upper for the shoe, comprises a posterior portion 14*a* surrounding the rear portion of the heel of the wearer and mates tightly therewith. This posterior portion 14*a* extends frontwardly on both sides of the longitudinal plane of symmetry of the shoe by means of an upwardly extending tongue 14*b*. Posterior portion 14*a* comprises a reinforcement on the inside thereof, as in the embodiment of FIG. 1, mating with the rear of the heel and extending towards the front and ending substantially beneath the malleoli of the ankle.

Posterior portion 14 of the vamp and overshoe 2 are attached to one another, on each side of the shoe by stitching 15 which extends between sole 1 and upper edge 9 of the upper, surrounding the rear of the foot. Stitching 15 preferably follows (i.e., is substantially parallel to) the posterior edge 2*a* of overshoe 2. Posterior edge 2*a* can form a point 2*b* which is rearwardly directed. By virtue of the attachment of vamp 4 and overshoe 2 by means of stitches 15, the two anterior tongues 14*b* are substantially free to be dislaced and can, consequently, be tightened (i.e., displaced toward each other) on the instep, independently of anterior portion 13, which assures the maintenance of the shoe on the front of the foot. In order to tighten the instep, the two anterior tongues 14*b* preferably each have at least one eyelet 16, positioned at an end tongue 14*b*, facing the other eyelet 16 on the other tongue. Each eyelet is adapted to allow for the passage of a tightening lace which can be the same lace as lace 5, assuring the tightening of the front of the foot. Alternatively, the tightening lace passing through each eyelet of tongues 14*b* can be different from lace 5 so that this lace is independent from lace 5. When lace 5 is tied it holds the tongues 14 in their contracted, tightened position.

From the above description, it is clear that the shoe provides a perfect nesting of the heel in the periphery of the upper of the shoe and also tightly maintains the upper around the heel, by means of the tightening or contraction of the posterior portion 14 of the vamp.

In the embodiment illustrated in FIG. 3, each tongue 14*b* is defined by a lower edge 14*c* which is inclined from the bottom to the top of the shoe and from the rear to front of the shoe, beginning with the sole. Edge 14*c* extends substantially parallel to the posterior edge 13*a* of the anterior portion 13 of the sole.

Figure 4:
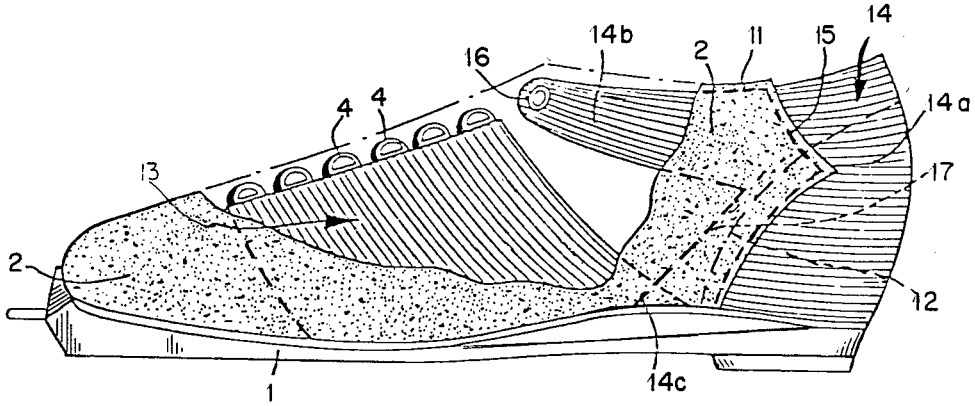

In the embodiment illustrated in FIG. 4, posterior portion 14 of the vamp has, on each side, a cutaway portion 17. Cutaway portion 17 is open at the front and defines a tongue 14*b* at an upper portion thereof. Cutaway portion 17 also has a pointed extension 14*c* at a lower portion thereof, which is directed to the front and attached to sole 1. Pointed extension 14*c* can overlap the lower posterior zone of the anterior portion 13 of the vamp. In other respects, the embodiments of FIGS. 3 and 4 are the same.

Figure 5:
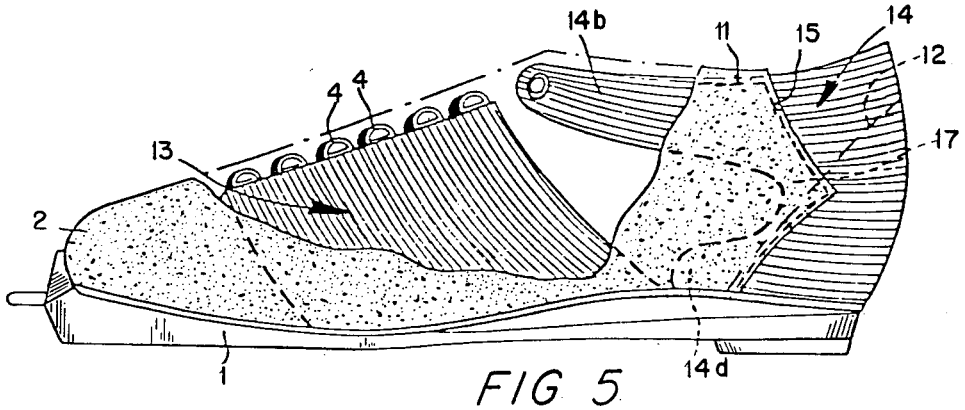

FIG. 5 illustrates an alternative embodiment in which cutaway portion 17, provided in posterior portion 14 of the vamp, defines a lower tongue 14*d* extending frontwardly and having a rounded edge. Tongue 14*d* can be spaced from anterior portion 13 of the vamp or can overlap it as in the embodiment illustrated in FIG. 4.

Figure 6:
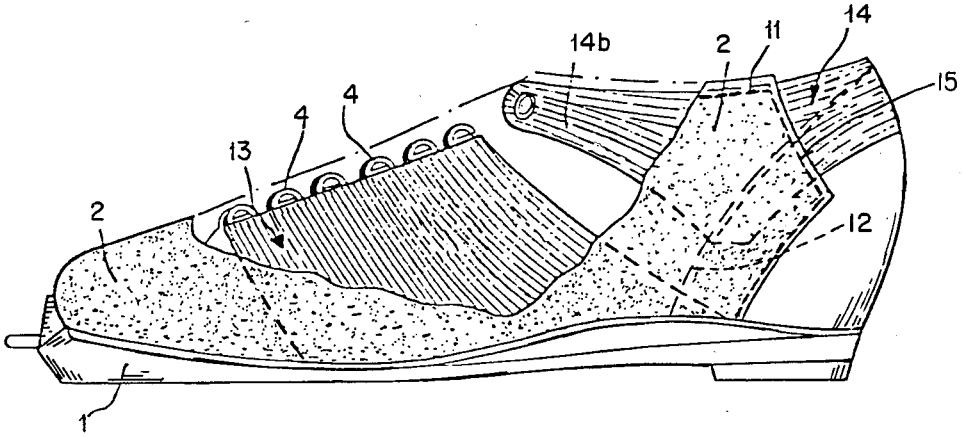

In an alternative embodiment illustrated in FIG. 6, the posterior portion 14 of the vamp is spaced from and does not extend to sole 1, but, rather, it is attached to a reinforcement 12 which, in turn, is attached to sole 1.

Figure 7:
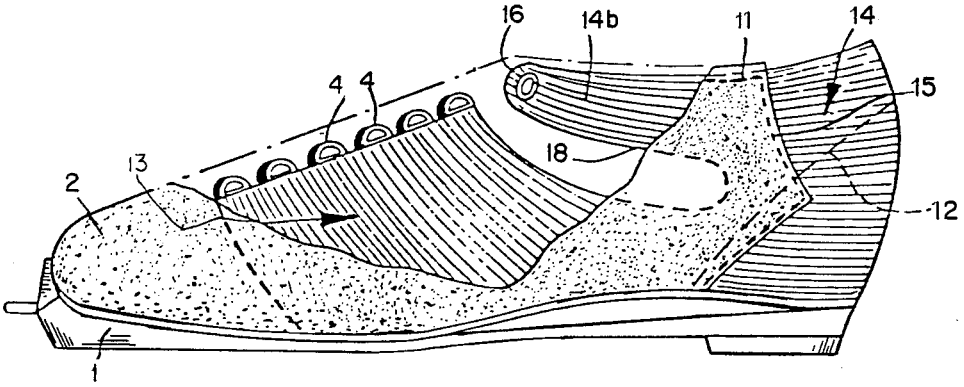

In the embodiment illustrated in FIG. 7, the anterior portion 13 and posterior portion 14 of the vamp are one integral piece and are separated from one another, on each side of the shoe, by a cutaway portion 18 which is inclined from the top to the bottom of the shoe, and from the front to the rear of the shoe so as to define the two upper and anterior tongues 14*b* which assure a tightening of the heel.

Although the description which has preceded emphasizes sport shoes having uppers that are small, it is self-evident that the invention also applies to sport shoes having a raised upper which is illustrated, by way of non-limiting example, in FIG. 2.

Furthermore, although the invention has been described with reference to particular means, materials and inventions it is to be understood that the invention is not limited to the particulars disclosed and extends to all equivalents within the scope of the claims.

What is claimed is:

1. A shoe for housing the instep and rear portions of a foot, wherein said shoe comprises:

(a) a sole (b) a flexible overshoe having a posterior portion comprising an upper edge portion; and (c) a vamp, inside said overshoe and comprising a posterior portion having an upper edge portion and tightening means for tightening said vamp around the instep of said foot, wherein at least a portion of said upper edge portion of said posterior portion of said overshoe is attached to said vamp along at least a portion of said upper edge portion of said posterior portion of said vamp, and wherein said overshoe is also attached to said vamp from said upper edge portion of said posterior portions of said vamp and overshoe to said sole.

2. The shoe defined by claim 1 wherein said shoe is a sports shoe.

3. The shoe, defined by claim 1 wherein said shoe is a cross-country ski shoe.

4. The shoe defined by claim 1 wherein said shoe has an upper edge surrounding the rear portion of the foot and wherein the tightening means contracts said upper edge of said shoe around the rear portion of the foot.

5. The shoe defined by claim 1 wherein said vamp comprises an anterior portion and wherein said tightening means is positioned on said anterior portion and said overshoe comprises an upper portion above said tightening means of said vamp adapted to be opened and closed, and wherein said overshoe further comprises rapid attachment means on said upper portion of said overshoe, for relatively rapidly opening or closing said upper portion to provide access to said tightening means of said vamp.

6. The shoe defined by claim 5 wherein said rapid attachment means comprises a waterproof closure for said upper portion of said overshoe.

7. The shoe defined by claim 1 wherein said vamp further comprises anterior and posterior portions and wherein said anterior and postering portions of said vamp comprise one piece.

8. The shoe defined by claim 7 wherein said shoe comprises top and bottom portions, and rear end front portions and wherein said vamp further comprises a cutaway portion, separating said anterior and posterior portions on each side of said shoe, wherein said cutaway portion is inclined from said top to said bottom portions and from said front to said rear portions of said shoe, wherein said cutaway portion comprises two upper anterior tongues comprising said tightening means.

9. The shoe, defined by claim 1 wherein said shoe houses the heel of a wearer and wherein said overshoe is connected to said vamp such that said overshoe comprises means for firmly maintaining the heel of said wearer in said shoe.

10. The shoe defined by claim 9 wherein said vamp comprises means for maintaining the front of the foot and the heel of the foot firmly in said shoe during substantial forward flexion.

11. The shoe defined by claim 1 wherein said vamp comprises an anterior portion wherein said anterior and posterior portions of said vamp are independent of one another.

12. The shoe defined by claim 11 wherein said anterior portion comprises two wings, each having longitudinal edges and wherein each wing is attached to said sole along said longitudinal edge, and wherein each wing further comprises an upper edge, wherein said tightening means is positioned along substantially the entire length of said upper edge.

13. The shoe defined by claim 12 wherein said shoe is adapted to house a heel and rear portion of the foot of a wearer, and wherein said posterior portion of said vamp is adapted to surround said rear portion and the heel of the wearer and comprises means for mating tightly therewith in response to said tightening means tightening said vamp at said front portion.

14. The shoe defined by claim 13 wherein said posterior portion of said vamp extends frontwardly on both sides of the longitudinal plane of symmetry of said shoe.

15. The shoe defined by claim 14 wherein said posterior portion comprises a tongue extending frontwardly on both sides of the longitudinal plane of symmetry of said shoe and extending upwardly, and wherein said tongue also comprises said tightening means.

16. The shoe defined by claim 15 wherein said shoe comprises stitches and said overshoe comprises a posterior portion attached to said posterior portion of said vamp by said stitches.

17. The shoe defined by claim 16 wherein said posterior portion of said vamp comprises a cutaway portion open at the front thereof and comprising an upper portion, and a lower portion, wherein said upper portion comprises said tongue and said lower portion comprises an extension, extending toward the front of said shoe and attached to said sole.

18. The shoe defined by claim 17 wherein said anterior portion of said vamp comprises a lower posterior zone and wherein said extension overlaps said lower posterior zone of said anterior portion of said vamp.

19. The shoe defined by claim 18 wherein said shoe further comprises a reinforcing attached to said sole and wherein said posterior portion of said vamp is attached to said reinforcement.

20. The shoe defined by claim 19 wherein said posterior portion of said vamp is spaced from said sole.

21. The shoe defined by claim 19 wherein said posterior portion is attached to said sole.

22. The shoe defined by claim 1 wherein said vamp further comprises an upper portion and wherein said tightening means is provided on said upper portion of said vamp.

23. The shoe defined by claim 22 wherein said shoe further comprises a sole to which said vamp is attached.

24. The shoe defined by claim 23 wherein said shoe comprises a front end and an instep and said vamp further comprises a posterior portion, an anterior portion, and an upper portion, and wherein said overshoe extends to said front end and substantially completely covers said anterior and upper portions of said vamp to assure tightening of the instep of said shoe when said tightening means tightens said vamp around the instep of said foot.

25. The shoe defined by claim 24 wherein said posterior portion of said overshoe is attached to said posterior portion of said vamp.

26. The shoe defined by claim 25 wherein said shoe further comprises attachment means for attaching said posterior portion of said overshoe to said vamp.

27. The shoe defined by claim 26 wherein said posterior portion of said vamp comprises an upper portion having an upper edge and wherein said attachment means attaches at least a portion of said upper portion of said posterior portion of said vamp to said posterior portion of said overshoe.

28. The shoe defined by claim 27 wherein said attachment means attaches at least a portion of said upper edge of said posterior portion of said vamp to said posterior portion of said overshoe.

29. The shoe defined by claim 28 wherein said vamp comprises a portion between said upper edge of said posterior portion of said vamp and said sole, and wherein said attachment means attaches said portion of said vamp to said posterior portion of said overshoe.

30. The shoe defined by claim 29 wherein said attachment means comprises stitching.

31. The shoe defined by claim 29 wherein said attachment means comprises glue.

32. The shoe defined by claim 29 wherein said attachment means comprises a heat weld.

33. The shoe defined by claim 29 wherein said shoe further comprises a top portion, a bottom portion and a rear portion and wherein said anterior portion of said vamp is spaced from said front end of said shoe and wherein said anterior portion comprises an anterior edge inclined from said top to said bottom portion of said shoe, and inclined from said front end to said rear portion of said shoe.

34. The shoe defined by claim 29 wherein said tightening means is positioned on said anterior portion and said overshoe further comprises an upper portion above said tightening means, wherein said upper portion comprises two spaced apart lips adapted to be overlaid, one on the other, and wherein each lip comprises a self-sticking portion adapted to stick to the self-sticking portion on the other lip.

35. The shoe defined by claim 29 wherein said vamp is one integral piece.

36. The shoe defined by claim 29 wherein said shoe comprises a heel and wherein said posterior portion of said overshoe comprises two posterior edges and said attachment means attachment said overshoe to said vamp along substantially the entire length of said two posterior edges of overshoe, parallel to said posterior edges and extending from said upper edge of said vamp to said heel.

37. A shoe for housing the front and rear portions of a foot, comprising:

(a) an exterior portion having an upper posterior portion;

(b) an interior portion having an upper posterior portion;

(c) sole; and (d) rear tightening means, positioned in said interior portion, for tightening said shoe on the rear portion of said foot in response to tightening said shoe on the front portion of said foot, wherein said rear tightening means comprises means for attaching said exterior and interior portions along at least a portion of their upper posterior portions and from said upper posterior portions to said sole.

38. The shoe defined by claim 37 wherein said shoe further comprises:

(d) front tightening means for tightening said shoe on the front portion of said foot.

39. The shoe defined by claim 38 wherein said shoe further comprises a vamp on the interior portion, wherein said vamp comprises said front tightening means and said rear tightening means.

40. The shoe defined by claim 39 wherein said vamp extends around said foot and comprises:

(i) a front portion comprising two spaced apart lateral wings, adapted to be displaced toward each other, and wherein said lateral wings comprise said front tightening means; and (ii) a rear portion surrounding the rear of said foot, and connected to said front portion, and wherein in response to displacement of said lateral wings toward each other, said rear portion diminishes in size.

41. The shoe defined by claim 40 wherein said lateral wings are in a first position when displaced toward each other and wherein said shoe further comprises holding means for holding said lateral wings in said first position.

42. The shoe defined by claim 41 wherein said holding means comprises:

(a) at least one opening in each lateral wing; and (b) lace, adapted to be threaded through said openings.

43. The shoe defined by claim 42 wherein said shoe further comprises an overshoe, having a rear portion and covering said vamp and attached to said vamp such that said rear portion of said overshoe diminishes in size in response to displacement of said lateral wings toward each other.

44. The shoe defined by claim 43 wherein said overshoe further comprises a front portion having two spaced apart lips, adapted to be overlaid one on the other, wherein said lips comprised a waterproof seal when overlaid one on the other.

45. The shoe defined by claim 44 wherein said lips each comprise a self-sticking surface adapted to contact the self-sticking surface on the other lip when said lips are overlaid one on the other.

46. The shoe defined by claim 45 wherein said lips comprise means for gaining access to said front tightening means.

47. A shoe comprising a sole and an upper wherein said upper comprises:

(a) an overshoe having a rear portion comprising an upper portion;

(b) a vamp, inside said overshoe, and wherein said vamp comprises:

(i) a front portion;

(ii) a rear portion comprising an upper portion; and (iii) contraction means for contracting said rear portion of said vamp and overshoe in response to contraction of said front portion of said vamp, wherein said contraction means comprises means for attaching said rear portions of said overshoe and vamp along at least a portion of said upper portions of said rear portions of said vamp and said overshoe and from said upper portions of said near portions of said overshoe and vamp to said sole.

48. The shoe defined by claim 47 wherein said overshoe comprises a rear portion and is attached to said vamp such that said rear portion of said overshoe contracts in response to contraction of said front portion of said vamp.

49. The shoe defined by claim 48 wherein said vamp further comprises a rear portion and wherein said front portion of said vamp is attached to said rear portion, and wherein said front portion of said vamp comprises two spaced apart lateral wings adapted to be displaced toward each other, wherein said rear portion of said vamp contracts in response to displacement of said lateral wings toward each other, wherein said contraction means comprises said lateral wings.

50. The shoe defined by claim 49 wherein said shoe further comprises means for maintaining the position of said lateral wings after said lateral wings are displaced toward each other.

51. A shoe for housing the instep and rear portions of a foot, wherein said shoe comprises:

(a) a flexible overshoe having a posterior portion and an anterior portion, wherein said overshoe covers said entire foot; and (b) a vamp, inside said overshoe and comprising tightening means for tightening said vamp around the instep of said foot, wherein said posterior portion of said overshoe is attached to said vamp, and wherein said vamp covers only a portion of said foot.

52. The shoe defined by claim 51 wherein said vamp further comprises anterior and posterior portions and wherein said anterior and posterior portions of said vamp comprise one piece, wherein said shoe comprises top and bottom portions, and rear end front portions and wherein said vamp further comprises a cutaway portion, separating said anterior and posterior portions on each side of said shoe, wherein said cutaway portion is inclined from said top to said bottom portions and from said front to said rear portions of said shoe, wherein said cutaway portion comprises two upper anterior tongues comprising said tightening means.

53. A shoe for holding the instep and rear portions of a foot, wherein said shoe comprises:

(a) a flexible overshoe having a posterior portion; and (b) a vamp, inside said overshoe wherein said vamp comprises anterior and posterior portions, wherein said anterior and posterior portions are spaced from each other and comprise separate portions, wherein said anterior portion comprises means for tightening said vamp around the instep of said foot, wherein said posterior portion of said vamp is attached to said posterior portion of said overshoe, wherein said posterior portion of said vamp comprises a portion over said instep of said foot and comprises means for tightening said posterior portion of said vamp and overshoe on said foot.

* * * * *